US010527964B2

(12) United States Patent
Biegelsen

(10) Patent No.: US 10,527,964 B2
(45) Date of Patent: Jan. 7, 2020

(54) ELECTROGRAPHIC PRINTING USING ENCAPSULATED INK DROPLETS

(71) Applicant: Palo Alto Research Center Incorporated, Palo Alto, CA (US)

(72) Inventor: David K. Biegelsen, Portola Valley, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 15/809,167

(22) Filed: Nov. 10, 2017

(65) Prior Publication Data

US 2019/0146374 A1 May 16, 2019

(51) Int. Cl.

| | |
|---|---|
| ***G03G 15/08*** | (2006.01) |
| ***G03G 15/06*** | (2006.01) |
| ***G03G 9/08*** | (2006.01) |
| ***G03G 9/093*** | (2006.01) |

(52) U.S. Cl.

CPC ..... *G03G 15/0808* (2013.01); *G03G 9/0819* (2013.01); *G03G 9/0827* (2013.01); *G03G 9/093* (2013.01); *G03G 9/09392* (2013.01); *G03G 15/065* (2013.01)

(58) Field of Classification Search

CPC ..... G03G 9/16

See application file for complete search history.

(56) References Cited

U.S. PATENT DOCUMENTS

| | | | | |
|---|---|---|---|---|
| 3,020,171 | A | 2/1962 | Bakan et al. | |
| 4,111,462 | A | 9/1978 | Lange et al. | |
| 4,973,541 | A * | 11/1990 | Kohri | G03G 9/093 428/402.21 |
| 5,852,073 | A | 12/1998 | Villiger et al. | |
| 5,923,412 | A | 7/1999 | Ertel | |
| 6,226,482 | B1 * | 5/2001 | Christy | G03G 15/0822 399/252 |
| 6,243,161 | B1 | 6/2001 | Suzuki et al. | |
| 6,376,147 | B1 * | 4/2002 | Bonsignore | G03G 9/122 430/114 |
| 7,001,091 | B1 | 2/2006 | Knight | |
| 8,221,953 | B2 | 7/2012 | Morales-Tirado et al. | |
| 8,347,787 | B1 | 1/2013 | Stowe et al. | |
| 2008/0026221 | A1 | 1/2008 | Vincent et al. | |
| 2010/0015541 | A1 * | 1/2010 | Ogawa | C08G 18/3206 430/59.6 |
| 2010/0129112 | A1 * | 5/2010 | Tada | G03G 5/0542 399/111 |

(Continued)

OTHER PUBLICATIONS

Isobar fluids factsheet, published 2018.*

(Continued)

*Primary Examiner* — Peter L Vajda

(74) *Attorney, Agent, or Firm* — Mueting, Raasch & Gebhardt, P.A.

(57) ABSTRACT

An electrographic printer includes an image carrier configured to receive ink capsules onto the surface of the image carrier. The image carrier is configured to transfer the ink capsules to a medium. The ink capsules comprise an ink having a viscosity in a range of about 100 cP to about and 100,000 cP and an encapsulant layer surrounding the ink. A roller configured to compress the ink capsules onto the medium such that the encapsulant layer ruptures and the ink adheres to the medium.

33 Claims, 6 Drawing Sheets

(56) References Cited

U.S. PATENT DOCUMENTS

| | | | | |
|---|---|---|---|---|
| 2011/0280635 | A1* | 11/2011 | Tomono | G03G 15/2096 399/327 |
| 2017/0176903 | A1* | 6/2017 | Oomoto | G03G 15/2017 |

OTHER PUBLICATIONS

Blaiszik et al., "Microencapsulation of gallium-indium (Ga—In) liquid metal for self-healing applications", Journal of Microencapsulation, Feb. 4, 2014, 5 pages.

* cited by examiner

ELECTROGRAPHIC PRINTING USING ENCAPSULATED INK DROPLETS

TECHNICAL FIELD

The present disclosure is directed to electrographic printing devices and methods related to such devices.

BACKGROUND

Electrographic printing systems use charge placed imagewise on a surface to attract markant to a predetermined formation. The markant can then be transferred to a medium to create a desired image on a receiving medium.

SUMMARY

Some embodiments are directed to an electrographic printer that includes an image carrier configured to receive ink capsules onto the surface of the image carrier. The image carrier is configured to transfer the ink capsules to a medium. The ink capsules comprise an ink having a viscosity in a range of about 100 cP to about and 100,000 cP and an encapsulant layer surrounding the ink. A roller configured to compress the ink capsules onto the medium such that the encapsulant layer ruptures and the ink adheres to the medium.

According to some embodiments a fluidized bed of ink capsules comprises an ink having a viscosity in a range of about 100 cP to about and 100,000 cP and an encapsulant layer surrounding the ink contained within the fluidized bed. An image carrier is configured to receive the ink capsules onto the surface of the image carrier and to transfer the ink capsules to a medium. A roller is configured to compress the ink capsules onto the medium such that the encapsulant layer ruptures and the ink adheres to the medium.

Some embodiments are directed to a method comprising receiving charged ink capsules onto the surface of an image carrier. The charged ink capsules comprise an ink having a viscosity in a range of about 100 cP to about and 100,000 cP and an encapsulant surrounding the ink. The charged ink capsules are transferred to a medium. The charged ink capsules are compressed onto the medium by a roller such that the encapsulant ruptures and the ink adheres to the medium.

Various embodiments are directed to an electrographic printer comprising an image carrier configured to receive ink capsules onto the surface of the image carrier and to transfer the ink capsules to a medium. The ink capsules comprise an offset ink and an encapsulant layer surrounding the ink. A roller is configured to compress the ink capsules onto the medium such that the encapsulant layer ruptures and the ink adheres to the medium.

Various embodiments are directed to a method comprising forming droplets of ink having a viscosity in a range of about 100 cP to about 100,000 cP. A subset of the ink droplets are selected according to size. The selected ink droplets are coated in an encapsulating layer. The encapsulating layer is hardened.

The above summary is not intended to describe each embodiment or every implementation. A more complete understanding will become apparent and appreciated by referring to the following detailed description and claims in conjunction with the accompanying drawings.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
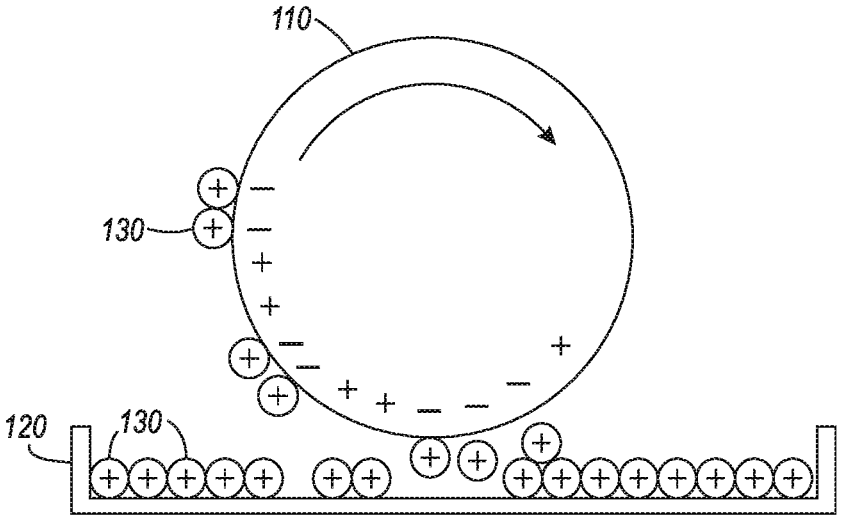
FIGS. 1A-1D illustrate a process for electrographic printing using encapsulated high viscosity ink according to embodiments described herein.

Electrographic printing involves generating a latent image of electric charge which can be developed by a markant (toner) oppositely charged. The ink and/or toner is then transferred to a substrate to form the desired image on the receiving substrate.

In some cases, the charged markant can be ink capsules that include ink surrounded by an encapsulant. Encapsulation enables compartmentalisation and protection of an interior core material from the external environment and minimizes agglomeration of particles until release is triggered. The ink may be a high viscosity ink. For example, the ink may have a viscosity greater than about 100 cP and less than 100,000 cP. In some cases, the ink is an offset ink. The encapsulant stops droplets from sticking together when in physical contact or ink adhering to the imaging surface. The encapsulated droplets may be captured by electrostatic potential wells created directly by photoconductive patterning on an image carrier surface, ionographic deposition on an insulating surface, or dielectric insulated electrode arrays on such a surface. In some cases, the image carrier is a drum. According to various embodiments, the image carrier is a belt. The encapsulated droplets are then transferred to a medium and then flattened using a low surface energy roller.

FIGS. 1A-1D illustrate a process for electrographic printing using encapsulated high viscosity ink. Ink capsules 130 are charged to a first state. According to various embodiments, the ink capsules are substantially spherical. In some cases, the charged ink capsules are ions. In some embodiments, the charged ink capsules are electrons. Elements on an image carrier 110 are selectively charged with polarity opposite to that of the ink capsules 130 to achieve a desired image. In some cases, the surface 110 has discrete electrode elements that can be charged and/or discharged. According to various embodiments, parts of the image carrier 110 are selectively charged without having discrete electrode elements located in the image carrier 110. For example, the image carrier 110 may have a continuous surface and is selectively charged by an ionographic print head in selected locations based on location on the image carrier. In some cases, the image carrier 110 may have a continuous photoconductive layer on its surface which is selectively charged by xerographic means. It is to be understood that elements on the surface can refer to discrete elements or location elements in a continuous image carrier surface as described above.

In some cases, the elements on the image carrier 110 that make up the desired image are charged to a second state, while all other elements on the image carrier 110 are charged to the first state and/or are in an uncharged state. The second state may be an uncharged state. The ink capsules 130 are attracted to the elements on the image carrier 110 that are charged to the first state and repelled and/or not attracted to the elements of the image carrier that are charged to the first state. Use of an AC field can facilitate toning only the oppositely charged regions by removing ink capsules preferentially from second state regions.

According to various embodiments, the ink capsules 130 are located in a container 120 that can facilitate a fluidized bed. Creating a fluidized bed can be accomplished by adding a propellant to the container 120 with the ink capsules 130 or by adding a carrier gas such as nitrogen to levitate and transport the ink capsules 130. This causes the ink capsules 130 to behave like a liquid. In some cases, the propellant can impart a charge to the ink capsules 130. This can be achieved through triboelectric charging and/or electric field charging, for example. The propellant may be configured to charge the ink capsules 130 to the first state. As the image carrier 110 rolls past the ink capsules 130 in the fluidized bed, the ink capsules 130 are attracted to the elements on the image carrier 110 that are charged to the second state, as described above.

Figure 1B:
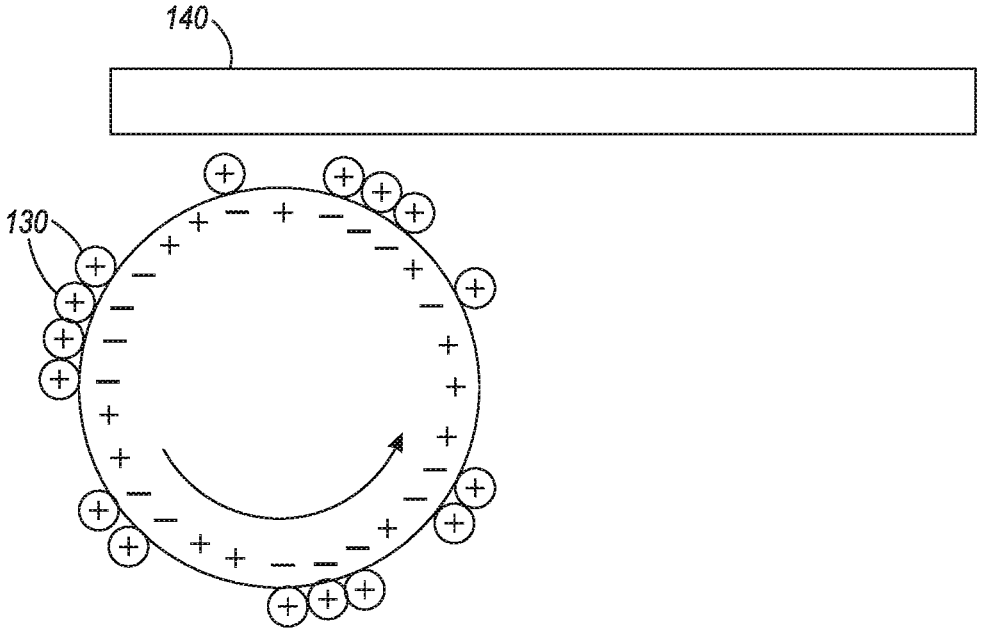

Once the ink capsules 130 are on the surface of the image carrier 110, the image carrier 110 then rolls over a medium 140 as shown in FIG. 1B. According to various embodiments, the medium is a receiving medium. A wide variety of media may be employed for a receiving medium such as paper, plastic, foil, fabric, composite sheet film, ceramic, and glass, for example. In some cases, the medium 140 is an intermediate transfer surface and the ink is transferred to the receiving medium from the intermediate transfer surface. The intermediate transfer surface may have a low surface energy layer and the ink capsules may be crushed on the intermediate transfer surface before the ink is transferred to the receiving medium.

Figure 1C:
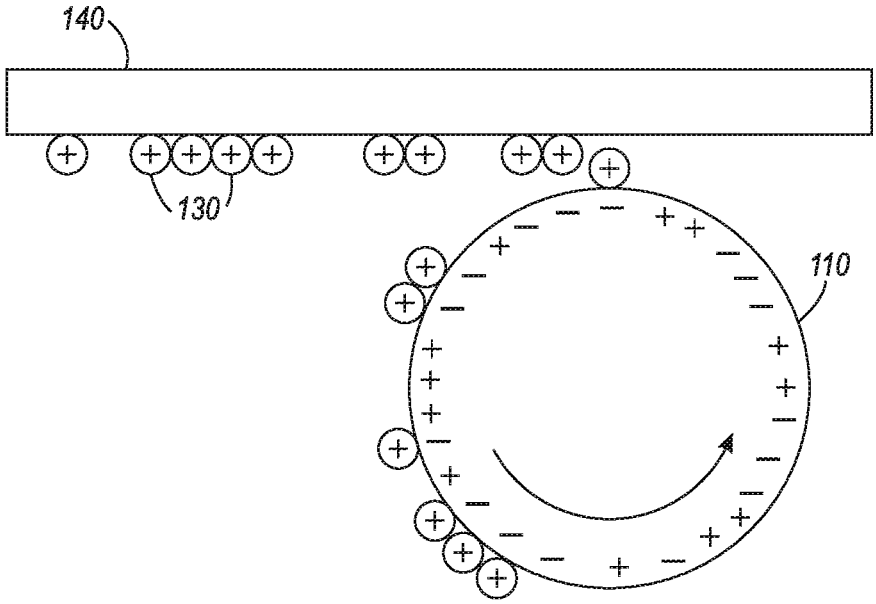
Figure 1D:
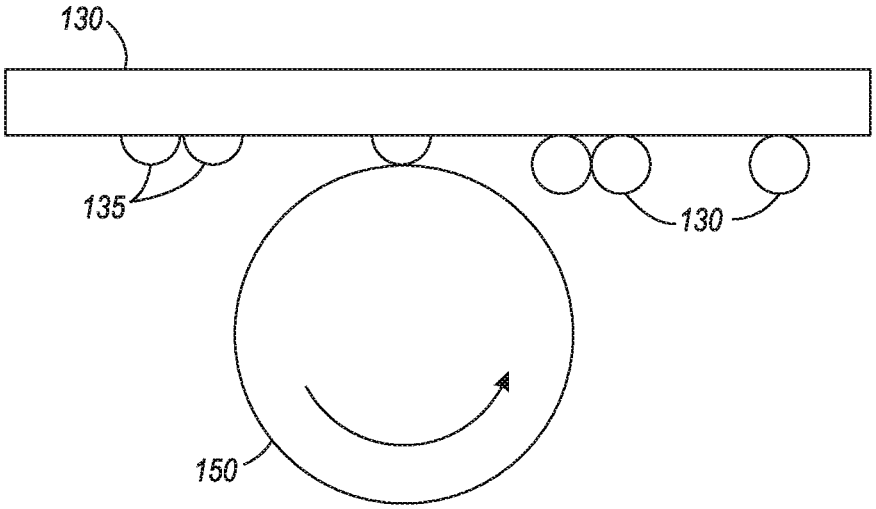

In some cases, an electric field is applied to attract the charged capsules to the medium 140. As the image carrier 110 rolls over the medium 140, the ink capsules 130 are transferred to the medium 140 in the pattern of the desired image as shown in FIG. 1C. Once the ink capsules 130 have been transferred to the medium 140, a roller 150 is rolled over the ink capsules 130 on the medium 140. As the roller 150 is rolled over the medium 140, the ink capsules 130 are crushed causing the encapsulant to rupture. The ink droplets 135 held within the encapsulant preferentially adhere to the medium 140. The surface energy of the roller is very low so that the ink does not adhere to its surface. In some embodiments, a very thin layer of low surface energy fluid such as octamethylcyclotetrasiloxane (D4) can be continuously coated on the image carrier to provide such a surface. In some cases, a wiping and/or a scraping unit is configured to remove any remaining debris on the roller 150 after the ink capsules 130 are crushed.

The charging of the image carrier can be accomplished in several ways. According to various embodiments described herein, the image carrier has a photoconductive surface layer. The photoreceptor surface layer is charged with a charging device and subsequently irradiated with a laser beam modulated in order discharge illuminated regions to form an electrostatic latent image. The ink capsules are then selectively attracted to the image carrier to create a desired image on the image carrier. The desired image is then transferred to a medium. Various types of charging devices may be used. For example, corotron and/or scorotron devices may be used. These devices perform charging by using corona discharge generated by applying a high voltage to a common metal wire.

Figure 2A:
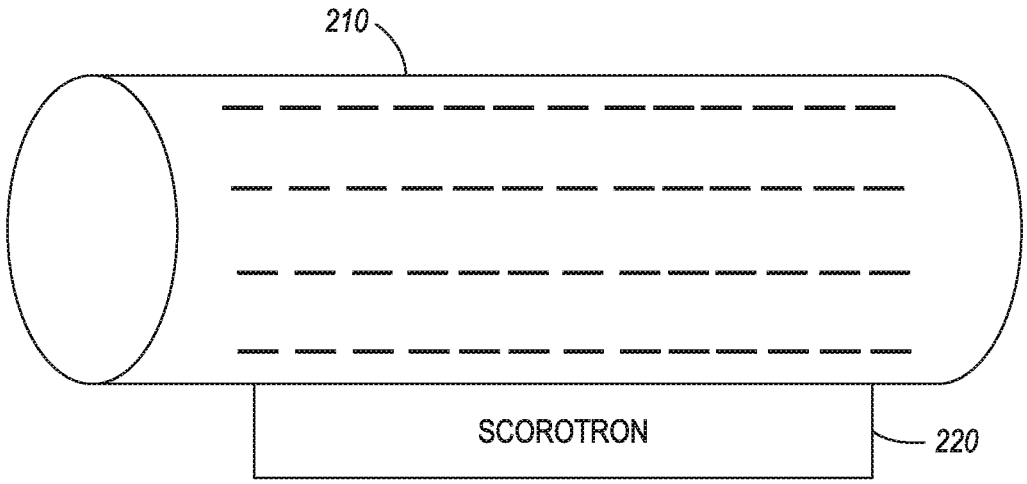
FIGS. 2A and 2B illustrate a process using a scorotron and an array of photoreceptors on the image carrier for use with an electrographic printing according to embodiments described herein.
Figure 2B:
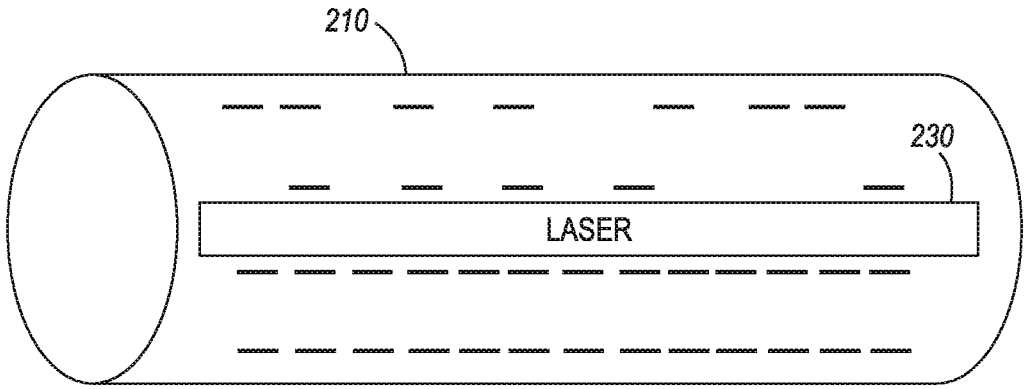

FIGS. 2A and 2B illustrate a process using a scorotron 220 and a photoreceptor layers on the image carrier 210. The scorotron 220 may be disposed in a non-contact state over the surface of the photoconductor image carrier 210. The scorotron 220 is used to apply a uniform charge on the image carrier 210. Scorotron corona charging devices have a similar structure, but are characterized by a conductive screen or grid interposed between the coronode and the photoreceptor surface, and biased to a voltage to provide the desired charge density on the photoreceptor surface. The screen tends to share the corona current with the photoreceptor surface. As the voltage on the photoreceptor surface increases towards the voltage level of the screen, corona current flow to the screen is increased, until all the corona current flows to the screen and no further charging of the photoreceptor takes place. For this reason, scorotrons are particularly desirable for applying a desired uniform charge to the charge retentive surface. After the photoreceptor on the image carrier 210 is at a uniform charge a laser 230 or other device may be used to change the charge of selective elements to create the electrostatic image as shown in FIG. 2B. In some cases, the laser 230 is used to selectively optically discharge elements on the image carrier 210 to provide an electrostatic image on the image carrier 210 that attracts the charged ink capsules.

According to various configurations described herein, the image carrier 210 comprises an insulating layer and a source is configured to direct ions toward the insulating layer of the image carrier 210 to form an electrostatic image on the insulating layer that in turn attracts the charged ink capsules. A scorotron 220 may be used to set a uniform initial state. Another device may be used to neutralize the charge caused by the scorotron. For example, an ionographic print head may be used to selectively neutralize the charge on the image carrier to create an image. Optionally, the ionographic print head may further charge selected regions to a charge state opposite to that of the latent image charge state, thereby being more effective in repelling ink capsules from those regions. In some cases, the image carrier 210 is initially in an uncharged state and an ionographic print head is used to selectively charge the image carrier 210 to create the electrostatic image. The charge on the image carrier 210 may then be neutralized in an AC electric field before forming subsequent images.

Figure 3:
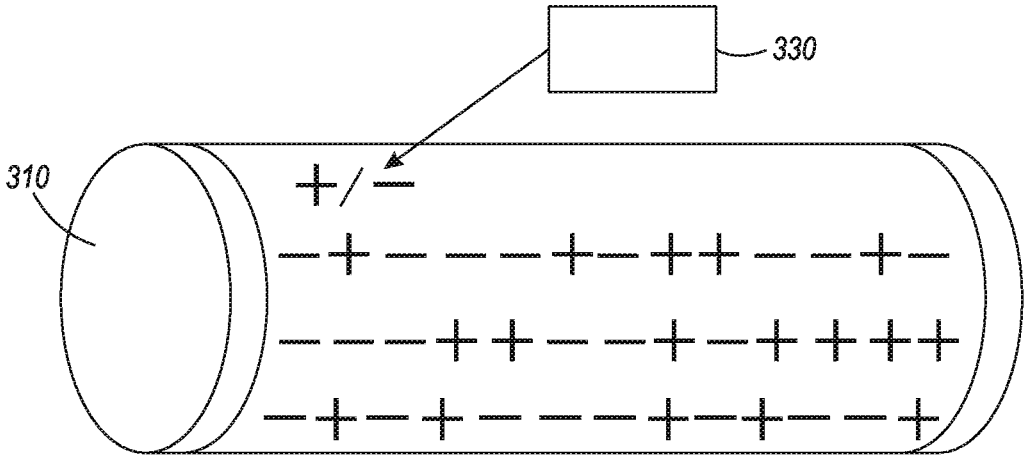
FIG. 3 illustrates an electrographic printing system using an electron gun according to embodiments described herein.

According to various embodiments an electron and/or an ion gun is used to create an electrostatic image on the image carrier 310. The electron/ion gun 330 can selectively charge individual elements on the image carrier 310 to a positive and/or a negative charge as shown in FIG. 3. In some cases, the electron/ion gun 330 only charges elements on the image carrier 310 that will repel the ink capsules to create the image and leave other elements uncharged. The electron/ion gun 330 may only charge elements on the image carrier 310 that attract the ink capsules to create the electrostatic image while leaving the other elements on the image carrier 310 in an uncharged state.

Figure 4:
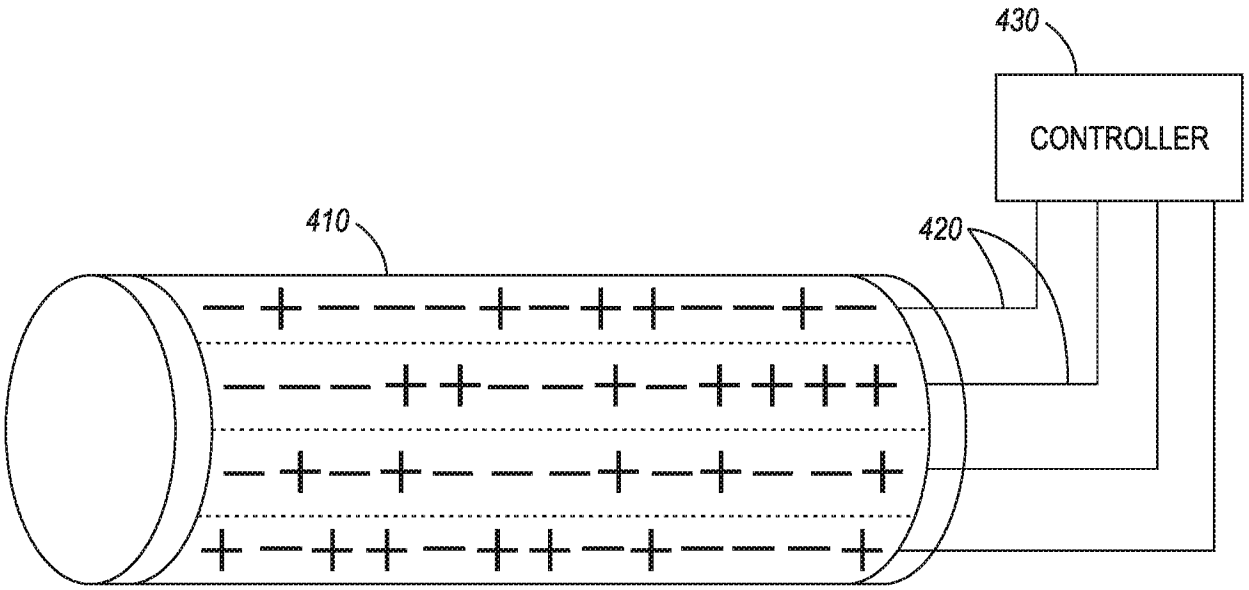
FIG. 4 illustrates a process that utilizes a high voltage electrostatic array for use with an electrographic printing according to embodiments described herein.

FIG. 4 illustrates a process that utilizes a high voltage electrostatic array. In some cases the image carrier 410 comprises an array of electrodes that are individually addressable by a controller 430 via control lines 420. The electrodes may be insulted from each other and can be individually charged with a high voltage source. Each of the elements on the image carrier 410 can be selectively charged or discharged to create an electrostatic image that corresponds to a desired final image.

Figure 5:
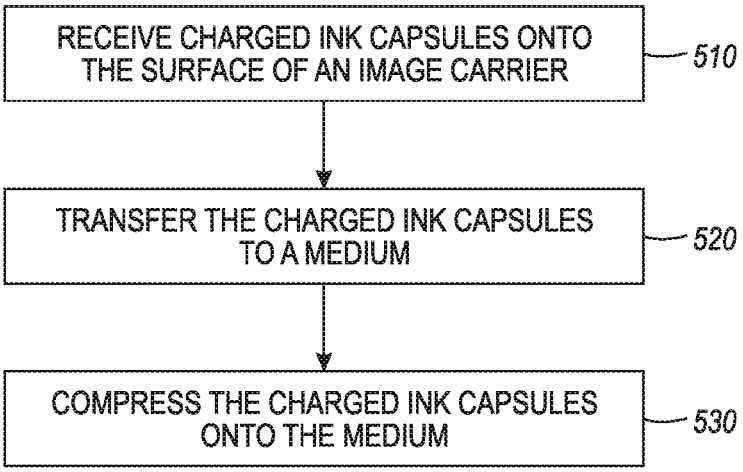
FIG. 5 illustrates a method for using ink capsules in an electrographic printing process. According to embodiments described herein.

FIG. 5 illustrates a method for using ink capsules in an electrographic printing process. Charged ink capsules are received 510 onto the surface of an image carrier. The ink in the charged ink capsules may have a viscosity of greater than 100 cp. The image carrier may be charged in any of the manners described herein. The charged ink capsules are transferred 520 from the image carrier to a medium. According to various embodiments, the medium is a receiving medium.

In some cases, the medium is an intermediate transfer surface and the ink is transferred to the receiving medium from the intermediate transfer surface. The intermediate transfer surface may have a low surface energy layer and the ink capsules may be crushed on the intermediate transfer surface before the ink is transferred to the receiving medium.

In some cases, the medium may be charged in such a way as to attract the ink capsules and/or the image carrier may be charged to repel the ink capsules as the image carrier rolls over the medium. The ink capsules are then compressed 530 by a roller releasing the ink within onto the medium. In some cases, the roller is coated with a low surface energy layer such as cyclosiloxane. The low surface energy layer may be reapplied to the roller periodically. In some cases, the roller is coated with a low surface energy fluid.

Figure 6:
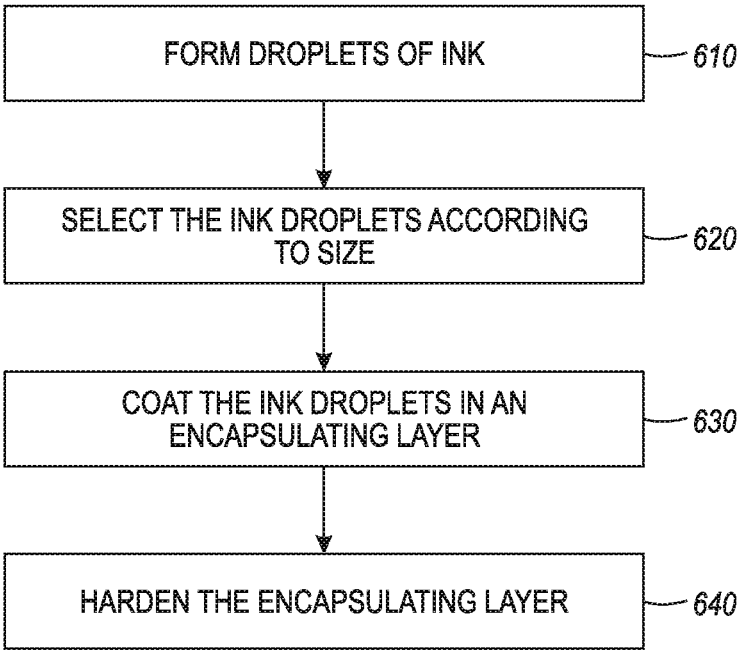
FIG. 6 illustrates a process for forming encapsulated ink according to embodiments described herein.

FIG. 6 illustrates a process for forming encapsulated ink having a high viscosity. Droplets of ink are formed 610. According to various embodiments described herein, the ink droplets have a viscosity of greater than about 100 cP, and less than about 100,000 cP, for example. A subset of the ink droplets are selected 620 according to size. This may be done to create ink droplets of roughly equal size, for example. Ink droplets greater than and less than a predetermined size range may be eliminated and/or reformed. In some cases, ink droplets of the desired size are formed having diameters in a range of about 5 μm to about 10 μm. Selecting the ink droplets may involve sorting the ink droplets in the group with desired size having a diameter standard deviation of the ink droplets less than 2 μm. Ink droplets less than or greater than a predetermined size range may be eliminated and/or reformed. The accepted ink droplets are coated 630 in an encapsulating layer. The encapsulating layer can then be hardened 640. According to various embodiments, the encapsulant comprises a monolayer.

According to various embodiments described herein, the ink droplets are created by using a sonication process. Sonication involves using sound waves to agitate and separate the ink into spherical droplets of correct size and with a narrow dispersion in diameters. The ink contains the pigment and binder fluid as well as other components of flexo or offset inks. This can be used to create separate ink droplets that can later by encapsulated.

The ink droplets may be formed in various ways. In some cases, the ink droplets are formed by an emulsion aggregation process. This process involves emulsifying the ink and aggregating sub-micron droplets including at least one colorant and a colorant vehicle comprising pigment particles and a binder such as an oleophilic or hydrophilic liquid in a reactor having an impeller. The impeller rotates the mixture at a speed of 3 meters per second to about 5 meters per second to create aggregated ink droplets. The ink droplets can then be encapsulated in the encapsulant.

According to various embodiments, forming the droplets comprises forming the droplets by an extensional hardening process. This involves stretching a strain hardening fluid containing a colorant between two diverging surfaces. The ink can contain strain hardening molecules such as polyethylene oxide (PEO) to provide strain hardening functionality. The strained fluid forms a fluid filament by applying a strain to the fluid. When a capillary break-up point is reached for the fluid filament, the fluid filament breaks into a plurality of ink droplets.

Encapsulation can be achieved in various manners. Ink droplets formed in air, such as by strain hardening, can be coated in an atmosphere containing for example parylene monomers. In some cases, the vapor can include two components which are serially adsorbed and reacted on the droplet surface while the droplets are still suspended. According to various embodiments, the ink droplets are coated while in a liquid environment. One such process uses a urea-formaldehyde reaction. The method uses sequential adsorption on the droplet surfaces of one component such as urea followed by adsorption of another component such as formalin to polymerize and provide the encapsulating shell. Ink droplets may be formed in solution by sonication and/or emulsion-aggregation or precipitated into solution after exiting from an alternative droplet forming process. In many embodiments ultraviolet irradiation can be used to induce polymerization of the encapsulating shell.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. An electrographic printer, comprising:

an image carrier configured to receive ink capsules onto the surface of the image carrier and to transfer the ink capsules to a medium, the ink capsules comprising an ink having a viscosity in a range of about 100 cP to about and 100,000 cP and an encapsulant layer surrounding the ink; and a roller configured to compress the ink capsules onto the medium such that the encapsulant layer ruptures and the ink adheres to the medium.

2. The electrographic printer of claim 1, wherein the ink capsules are charged and the image carrier comprises an addressably charged surface which is configured to attract the charged ink capsules.

3. The electrographic printer of claim 1, wherein:

the ink capsules are electrostatically charged to a first state; and further comprising a scorotron configured to electrostatically charge the image carrier to a second state.

4. The electrographic printer of claim 3, further comprising a laser configured to selectively optically discharge image elements on the image carrier to provide an electrostatic image on the image carrier that attracts the charged ink capsules.

5. The electrographic printer of claim 1, wherein:

the image carrier comprises an insulating layer; and further comprising a source configured to direct the charged capsules toward the insulating layer of the image carrier to form an electrostatic image on the insulating layer that attracts the charged ink capsules.

6. The electrographic printer of claim 5, wherein the charged ink capsules comprise ions.

7. The electrographic printer of claim 5, wherein the charged capsules comprise electrons.

8. The electrographic printer of claim 1, wherein the roller comprises a low surface energy layer.

9. The electrographic printer of claim 1, wherein the roller is coated in a low surface energy fluid.

10. The electrographic printer of claim 1, wherein:

the ink capsules are electrostatically charged to a first state;

the medium is electrostatically charged to a second state; and wherein the charged ink capsules are transferred from the image carrier to the charged medium.

11. The electrographic printer of claim 1, wherein the medium is a receiving medium.

12. The electrographic printer of claim 11, wherein the roller is configured to compress the ink capsules onto the receiving medium.

13. The electrographic printer of claim 1, wherein the medium is an intermediate transfer surface.

14. The electrographic printer of claim 13, further comprising a receiving medium, wherein the roller is configured to compress the ink capsules onto the intermediate transfer surface and the intermediate transfer surface is configured to transfer the ink from the compressed ink capsules to the receiving medium.

15. The electrographic printer of claim 1, wherein the image carrier is a drum.

16. The electrographic printer of claim 1, wherein the image carrier is a belt.

17. An electrographic printing system comprising:

a fluidized bed of ink capsules comprising an ink having a viscosity in a range of about 100 cP to about and 100,000 cP and an encapsulant layer surrounding the ink contained within the fluidized bed;

an image carrier configured to receive the ink capsules onto the surface of the image carrier and to transfer the ink capsules to a medium; and a roller configured to compress the ink capsules onto the medium such that the encapsulant layer ruptures and the ink adheres to the medium.

18. The printing system of claim 17, wherein the ink capsules are substantially spherical.

19. The printing system of claim 17, wherein the encapsulant comprises a monolayer.

20. The printing system of claim 17, wherein the ink capsules comprise offset ink capsules.

21. The printing system of claim 17, further comprising at least one of a wiping and a scraping unit configured to remove any remaining debris on the roller after the ink capsules have been ruptured.

22. A method, comprising:

receiving charged ink capsules onto the surface of an image carrier, the charged ink capsules comprising an ink having a viscosity in a range of about 100 cP to about and 100,000 cP and having an encapsulant surrounding the ink;

transferring the charged ink capsules to a medium; and compressing the charged ink capsules onto the medium by a roller such that the encapsulant ruptures and the ink adheres to the medium.

23. An electrographic printer, comprising:

an image carrier configured to receive ink capsules onto the surface of the image carrier and to transfer the ink capsules to a medium, the ink capsules comprising an offset ink and an encapsulant layer surrounding the ink; and a roller configured to compress the ink capsules onto the medium such that the encapsulant layer ruptures and the ink adheres to the medium.

24. A method, comprising:

forming droplets of ink having a viscosity in a range of about 100 cP to about 100,000 cP;

selecting a subset of the ink droplets according to size;

coating the selected ink droplets in an encapsulating layer; and hardening the encapsulating layer.

25. The method of claim 24, wherein forming the droplets comprises forming the droplets by one of extensional hardening, sonication in a liquid, and an emulsion aggregation process.

26. The method of claim 24, wherein the encapsulant comprises at least one of urea formaldehyde and parylene.

27. The method of claim 24, wherein the ink comprises offset ink or other high viscosity fluid.

28. The method of claim 24, wherein coating the droplets comprises coating the droplets in a vapor.

29. The method of claim 28, wherein the vapor comprises parylene.

30. The method of claim 24, wherein coating the droplets comprises coating the droplets within a liquid.

31. The method of claim 30, wherein the liquid comprises urea-formaldehyde.

32. The method of claim 24, wherein:

forming the ink droplets comprises forming ink droplets having diameters of about 5 to about 10 microns; and a standard deviation of the diameters of the ink droplets in the selected subset is less than 2 microns.

33. The method of claim 24, wherein hardening the encapsulant comprises using ultraviolet (UV) radiation.

* * * * *